US010060245B2

(12) United States Patent
Cullick et al.

(10) Patent No.: US 10,060,245 B2
(45) Date of Patent: Aug. 28, 2018

(54) SYSTEMS AND METHODS FOR PLANNING WELL LOCATIONS WITH DYNAMIC PRODUCTION CRITERIA

(75) Inventors: Alvin Stanley Cullick, Houston, TX (US); Dan Colvin, Dripping Springs, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1142 days.

(21) Appl. No.: 12/351,754

(22) Filed: Jan. 9, 2009

(65) Prior Publication Data

US 2010/0179797 A1 Jul. 15, 2010

(51) Int. Cl.
*G06F 9/455* (2018.01)
*E21B 43/30* (2006.01)

(52) U.S. Cl.
CPC ..... *E21B 43/30* (2013.01)

(58) Field of Classification Search
CPC ..... E21B 43/30; E21B 43/305; E21B 43/38; E21B 47/00
USPC ..... 703/10; 702/6
See application file for complete search history.

(56) References Cited

U.S. PATENT DOCUMENTS

| | | | | |
|---|---|---|---|---|
| 7,096,172 | B2 | 8/2006 | Colvin et al. | |
| 2005/0211468 | A1* | 9/2005 | Veeningen et al. | 175/24 |
| 2007/0118346 | A1* | 5/2007 | Wen | E21B 43/00 703/10 |
| 2008/0066903 | A1* | 3/2008 | Zupanick | 166/245 |
| 2008/0120148 | A1 | 5/2008 | Narayanan et al. | |
| 2008/0126050 | A1 | 5/2008 | Logan | |
| 2008/0300793 | A1 | 12/2008 | Tilke et al. | |
| 2010/0057418 | A1* | 3/2010 | Li et al. | 703/10 |

FOREIGN PATENT DOCUMENTS

| | | |
|---|---|---|
| WO | 2005121840 | 12/2005 |
| WO | 2006065915 | 6/2008 |

OTHER PUBLICATIONS

Cullick, S., Heath, D. and Narayanan K., "Optimizing Multiple-Field Scheduling and Production Strategy with Reduced Risk," Journal of Petroleum Technology, vol. 56, No. 11, Nov. 2004 [retrieved Jan. 16, 2010] Retrieved from the Internet, http://www.halliburton.com/public/landmark/contents/Data_Sheets/JPTDMS2004.pdf> 6 pages.*

Cullick, Alvin; Narayana, Keshav; Gorell, Sheldon; "Optimal Field Development Planning of Well Locations with Reservoir Uncertainty" SPE 96986; Society of Petroleum Engineers Technical Conference and Exhibition; pp. 1-12; Dallas, TX Oct. 9-12, 2005.

The International Search Report and the Written Opinion of the International Searching Authority, PCT/US09/66913, dated Apr. 13, 2010, 9 pages.

(Continued)

*Primary Examiner* — Eunhee Kim

(74) *Attorney, Agent, or Firm* — Kilpatrick Townsend & Stockton LLP

(57) ABSTRACT

Systems and methods for automatically and optimally planning multiple well locations within a reservoir simulator. The systems and methods use dynamic production criteria to create and optimize well target completion intervals and the associated well geometries for new wells dynamically, and directly within a reservoir simulator.

14 Claims, 7 Drawing Sheets

(56) References Cited

OTHER PUBLICATIONS

Cullick, S., Heath, D. and Narayanan K., "Optimizing Multiple-Field Scheduling and Production Strategy with Reduced Risk," Journal of Petroleum Technology, vol. 56, No. 11, Nov. 2004 [retrieved Jan. 16, 2010] Retrieved from the Internet, <URL: http://www.halliburton.com/public/landmark/contents/ Data_Sheets/JPTDMS2004.pdf> 6 pages.
International Preliminary Report on Patentability; PCT/US09/66913; dated Oct. 21, 2011; 6 pages.
Mexican Institute of Industrial Property, Office Action, Mexican Patent Application No. MX/a/2011/008840, dated Oct. 7, 2013, 3 pages, Mexican Institute of Industrial Propertym Mexico.
Zheng, Suling; Second Notification of Office Action; Chinese Patent Application No. 200980153946.9, dated Feb. 26, 2014; 7 pages; The State Intellectual Property Office of China; China.
Australian Patent Application No. 2016222449 , "First Examination Report", dated Aug. 8, 2017, 5 pages.
Burak et al., Optimization of Nonconventional Well Type, Location, and Trajectory, Society of Petroleum Engineers Journal, vol. 8, Issue 3, Sep. 2003, Abstract.
Canadian Patent Application No. 2,745,880, Office Action, dated Oct. 13, 2016, 4 pages.
Canadian Patent Application No. 2,745,880, Office Action, dated Jul. 13, 2017, 5 pages.
Cullick et al., "Optimizing Field Development Concepts for Complex Offshore Production Systems", Society of Petroleum Engineers Journal, Dallas, Sep. 4, 2007, pp. 1-10.
European Patent Application No. 09837813.6, "Communication pursuant to Rule 164(1) EPC", dated Jan. 8, 2018, 15 pages.
Charles Berko, Patent Examination Report No. 1, Patent Application No. 2009336057, dated Dec. 4, 2014, 4 pages, Australian Government IP Australia, Australia.
Lars Koch, Response to Examination Report 1, Patent Application No. 2009336057, dated Dec. 16, 2014, 8 pages, Pizzeys Patent and Trademark Attorneys, Australia.
Charles Berko, Patent Examination Report No. 2, Patent Application No. 2009336057, dated Jan. 21, 2015, 7 pages, Australian Government IP Australia, Australia.

* cited by examiner

SYSTEMS AND METHODS FOR PLANNING WELL LOCATIONS WITH DYNAMIC PRODUCTION CRITERIA

CROSS-REFERENCE TO RELATED APPLICATIONS

Not applicable.

STATEMENT REGARDING FEDERALLY SPONSORED RESEARCH

Not applicable.

FIELD OF THE INVENTION

The present invention generally relates to planning well locations (targets) and corresponding wellbores. More particularly, the present invention relates to the use of dynamic production criteria to optimally plan multiple well locations and corresponding wellbores.

BACKGROUND OF THE INVENTION

In the oil and gas industry, current practice in planning a multiple-well package for a field does not include determination of the optimal placement for wells and their target completion zones based on the production from the field and the associated economics. Currently, well planning is limited to evaluating a few scenarios for well plans in a static-geologic model with manual and time-consuming evaluation in a simulator. This conventional well planning method, and its associated technology, is limited to multiple, discrete planning steps.

In "Optimal Field Development Planning of Well Locations with Reservoir Uncertainty" by Cullick et al. ("SPE 96986"), for example, a part of the well planning process is described as being automated by optimizing movement of perforation zones in a simulator to evaluate field production. Similarly, U.S. Pat. No. 7,096,172 describes automated well target selection based on static properties of the geologic formation. The workflow described in SPE 96986 begins with a static, geologic, base model of the oilfeld, which may include porosity, permeability, and the like. New well locations are planned based upon the static geologic model and the various corresponding properties in a three-dimensional grid, Cartesian grid or corner point grid. The new well locations and associated characteristics are exported as locations in a three-dimensional grid, for example. Perforations are then computed in the i, j, k grid coordinates and exported as well perforation intervals. A model is then compiled by selecting decision variables in a simulator data deck; selecting delta i, delta j, delta k for perforations subject to grid boundary conditions; selecting on off parameters for perforations; and setting up an objective function. The model is then executed by techniques further described in SPE 96986.

Nevertheless, the techniques and workflows described in SPE 96986 and U.S. Pat. No. 7,096,172, which are incorporated herein by reference, fail to describe a solution for: i) optimizing while simultaneously verifying well drillability and hazards; ii) computing updates to true well geometry/trajectory and tie-back connections to pipelines and delivery systems; and iii) locating optimal formation perforation zones with true production from dynamic flow of oil, gas, and water. In other words, these conventional techniques and workflows merely move perforations from one grid location to another grid location without recomputing the wellbore geometry and honoring drilling constraints.

There is therefore, a need for automatically planning well locations with dynamic production criteria.

SUMMARY OF THE INVENTION

The present invention therefore, meets the above needs and overcomes one or more deficiencies in the prior art by providing systems and methods for automatically planning well locations with dynamic production criteria.

In one embodiment, the present invention includes a computer implemented method for planning a well location, comprising: i) defining coordinates for each well target subject to a well target constraint and one or more sets of property filters wherein the one or more sets of property filters includes a pore volume property filter value assigned to each grid element in a three-dimensional grid representing a geological model; ii) computing a subsurface well plan for the well location, which connects each well target that satisfies a subsurface well plan constraint, the subsurface well plan constraint comprising a well type constraint or a cost constraint; iii) discarding at least one well target wherein the discarded well target does not satisfy the subsurface well plan constraint; iv) computing profile data for the subsurface well plan using a computer processor; v) computing a well perforation based on the one or more sets of property filters; vi) simulating production based on the well perforation, the subsurface well plan and the profile data; vii) computing an objective function for the well location based on data from the simulated production; and viii) determining whether a stopping criteria are met.

In another embodiment, the present invention includes a non-transitory program carrier device tangibly carrying computer executable instructions for planning a well location. The instructions are executable to implement: i) defining coordinates for each well target subject to a well target constraint and one or more sets of property filters wherein the one or more sets of property filters includes a pore volume property filter value assigned to each grid element in a three-dimensional grid representing a geological model; ii) computing a subsurface well plan for the well location, which connects each well target that satisfies a subsurface well plan constraint, the subsurface well plan constraint comprising a well type constraint or a cost constraint; iii) discarding at least one well target wherein the discarded well target does not satisfy the subsurface well plan constraint; iv) computing profile data for the subsurface well plan; v) computing a well perforation based on the one or more sets of property filters; vi) simulating production based on the well perforation, the subsurface well plan and the profile data; vii) computing an objective function for the well location based on data from the simulated production; and viii) determining whether a stopping criteria are met.

In yet another embodiment, the present invention includes a non-transitory program carrier device tangibly carrying a data structure, the data structure comprising a data field, the data field comprising a well plan based on dynamic production criteria, an objective function and a pre-established constraint comprising a well type constraint and a cost constraint, the well plan representing multiple wellbore trajectories with perforation locations on a geologic model wherein the dynamic production criteria and the objective function are iteratively computed to produce the well plan.

Additional aspects, advantages and embodiments of the invention will become apparent to those skilled in the art from the following description of the various embodiments and related drawings.

BRIEF DESCRIPTION OF THE DRAWINGS

The present invention is described below with references to the accompanying drawings in which like elements are referenced with like reference numerals, and in which.

DETAILED DESCRIPTION OF THE PREFERRED EMBODIMENTS

The subject matter of the present invention is described with specificity, however, the description itself is not intended to limit the scope of the invention. The subject matter thus, might also be embodied in other ways, to include different steps or combinations of steps similar to the ones described herein, in conjunction with other present or future technologies. Moreover, although the term "step" may be used herein to describe different elements of methods employed, the term should not be interpreted as implying any particular order among or between various steps herein disclosed unless otherwise expressly limited by the description to a particular order.

System Description

The present invention may be implemented through a computer-executable program of instructions, such as program modules, generally referred to as software applications or application programs executed by a computer. The software may include, for example, routines, programs, objects, components, and data structures that perform particular tasks or implement particular abstract data types. The software forms an interface to allow a computer to react according to a source of input. AssetPlanner™, Network Planner™, DataStudio™ and NEXUS® or, alternatively, VIP®, which are commercial software applications marketed by Landmark Graphics Corporation, may be used as interface applications to implement the present invention. The software may also cooperate with other code segments to initiate a variety of tasks in response to data received in conjunction with the source of the received data. The software may be stored and/or carried on any variety of memory media such as CD-ROM, magnetic disk, bubble memory and semiconductor memory (e.g., various types of RAM or ROM). Furthermore, the software and its results may be transmitted over a variety of carrier media such as optical fiber, metallic wire, free space and/or through any of a variety of networks such as the Internet.

Moreover, those skilled in the art will appreciate that the invention may be practiced with a variety of computer-system configurations, including hand-held devices, multiprocessor systems, microprocessor-based or programmable-consumer electronics, minicomputers, mainframe computers, and the like. Any number of computer-systems and computer networks are acceptable for use with the present invention. The invention may be practiced in distributed-computing environments where tasks are performed by remote-processing devices that are linked through a communications network. In a distributed-computing environment, program modules may be located in both local and remote computer-storage media including memory storage devices. The present invention may therefore, be implemented in connection with various hardware, software or a combination thereof in a computer system or other processing system.

Figure 1:
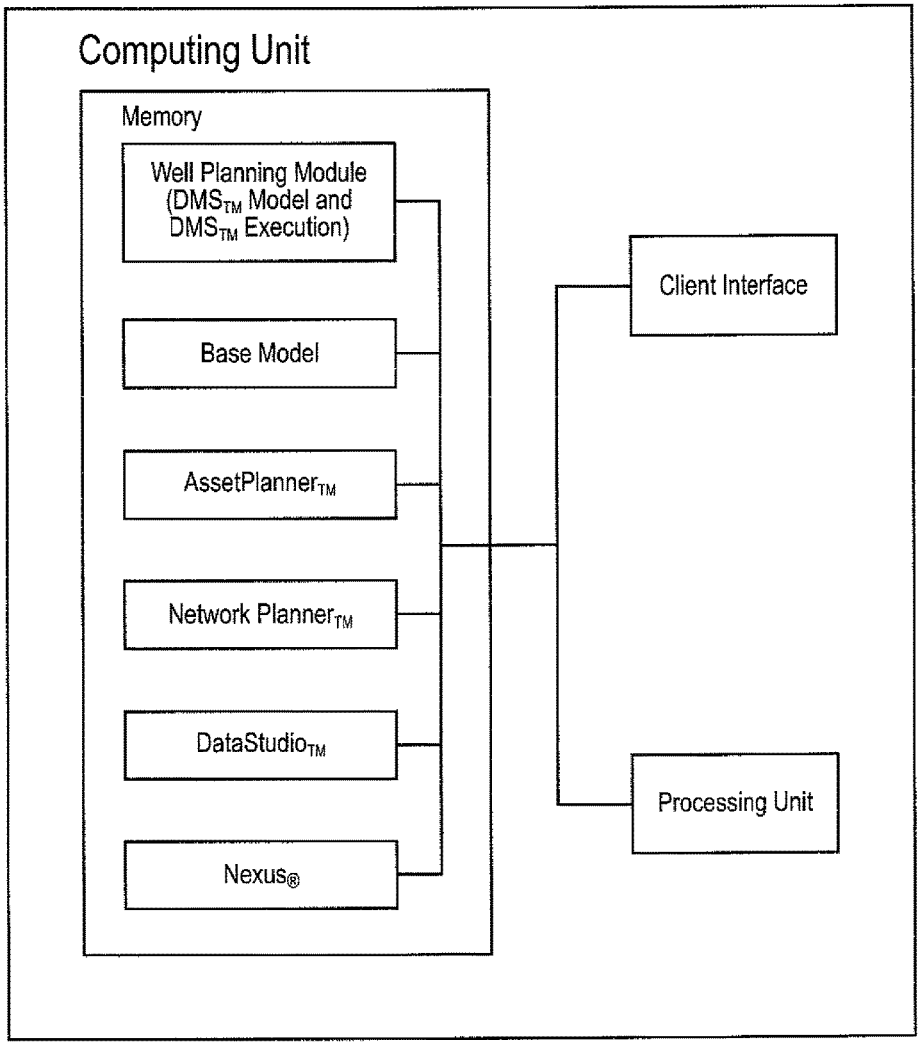
FIG. 1 is a block diagram illustrating a system for implementing the present invention.

Referring now to FIG. 1, a block diagram of a system for implementing the present invention on a computer is illustrated. The system includes a computing unit, sometimes referred to a computing system, which contains memory, application programs, a client interface, and a processing unit. The computing unit is only one example of a suitable computing environment and is not intended to suggest any limitation as to the scope of use or functionality of the invention.

The memory primarily stores the application programs, which may also be described as program modules containing computer-executable instructions, executed by the computing unit for implementing the methods described herein and illustrated in FIGS. 2-7. The memory therefore, includes a Well Planning Module, which enables the methods illustrated and described in reference to FIGS. 2-7. A Base Model includes a static, geologic model of the oilfield, which may include porosity, permeability, and the like. The Base Model is then used by AssetPlanner™ to compute new well targets and well plans based upon the static geologic model and the various corresponding properties in a three-dimensional grid, Cartesian grid or corner point grid. The new well targets and well plans are exported to Network Planner™ as locations in a three-dimensional grid, for example. Network Planner™ then computes well characteristics associated with the well plan using assigned values. DataStudio™ then processes the well plan and the well characteristics to compute perforations in the i, j, k grid space using assigned values, which are exported as well perforation intervals to the DMS Model.

The Well Planning Module includes the DMS Model, which may be executed according to the methods illustrated and described in reference to FIGS. 2-7. The Well Planning Module also may interact with the Base Model, AssetPlanner™, Network Planner™ and DataStudio™ during the DMS™ Execution as further described in reference to FIGS. 2-7.

Although the computing unit is shown as having a generalized memory, the computing unit typically includes a variety of computer readable media. By way of example, and not limitation, computer readable media may comprise computer storage media and communication media. The computing system memory may include computer storage media in the form of volatile and/or nonvolatile memory such as a read only memory (ROM) and random access memory (RAM). A basic input/output system (BIOS), containing the basic routines that help to transfer information between elements within the computing unit, such as during start-up, is typically stored in ROM. The RAM typically contains data and/or program modules that are immediately accessible to, and/or presently being operated on by, the processing unit. By way of example, and not limitation, the computing unit includes an operating system, application programs, other program modules, and program data.

The components shown in the memory may also be included in other removable/nonremovable, volatile/non-volatile computer storage media. For example only, a hard disk drive may read from or write to nonremovable, non-volatile magnetic media, a magnetic disk drive may read from or write to a removable, non-volatile magnetic disk, and an optical disk drive may read from or write to a removable, nonvolatile optical disk such as a CD ROM or other optical media. Other removable/non-removable, volatile/non-volatile computer storage media that can be used in the exemplary operating environment may include, but are not limited to, magnetic tape cassettes, flash memory cards, digital versatile disks, digital video tape, solid state RAM, solid state ROM, and the like. The drives and their associated computer storage media discussed above therefore, store and/or carry computer readable instructions, data structures, program modules and other data for the computing unit.

A client may enter commands and information into the computing unit through the client interface, which may be input devices such as a keyboard and pointing device, commonly referred to as a mouse, trackball or touch pad. Input devices may include a microphone, joystick, satellite dish, scanner, or the like.

These and other input devices are often connected to the processing unit through the client interface that is coupled to a system bus, but may be connected by other interface and bus structures, such as a parallel port or a universal serial bus (USB). A monitor or other type of display device may be connected to the system bus via an interface, such as a video interface. In addition to the monitor, computers may also include other peripheral output devices such as speakers and printer, which may be connected through an output peripheral interface.

Although many other internal components of the computing unit are not shown, those of ordinary skill in the art will appreciate that such components and their interconnection are well known.

Method Description

Figure 2:
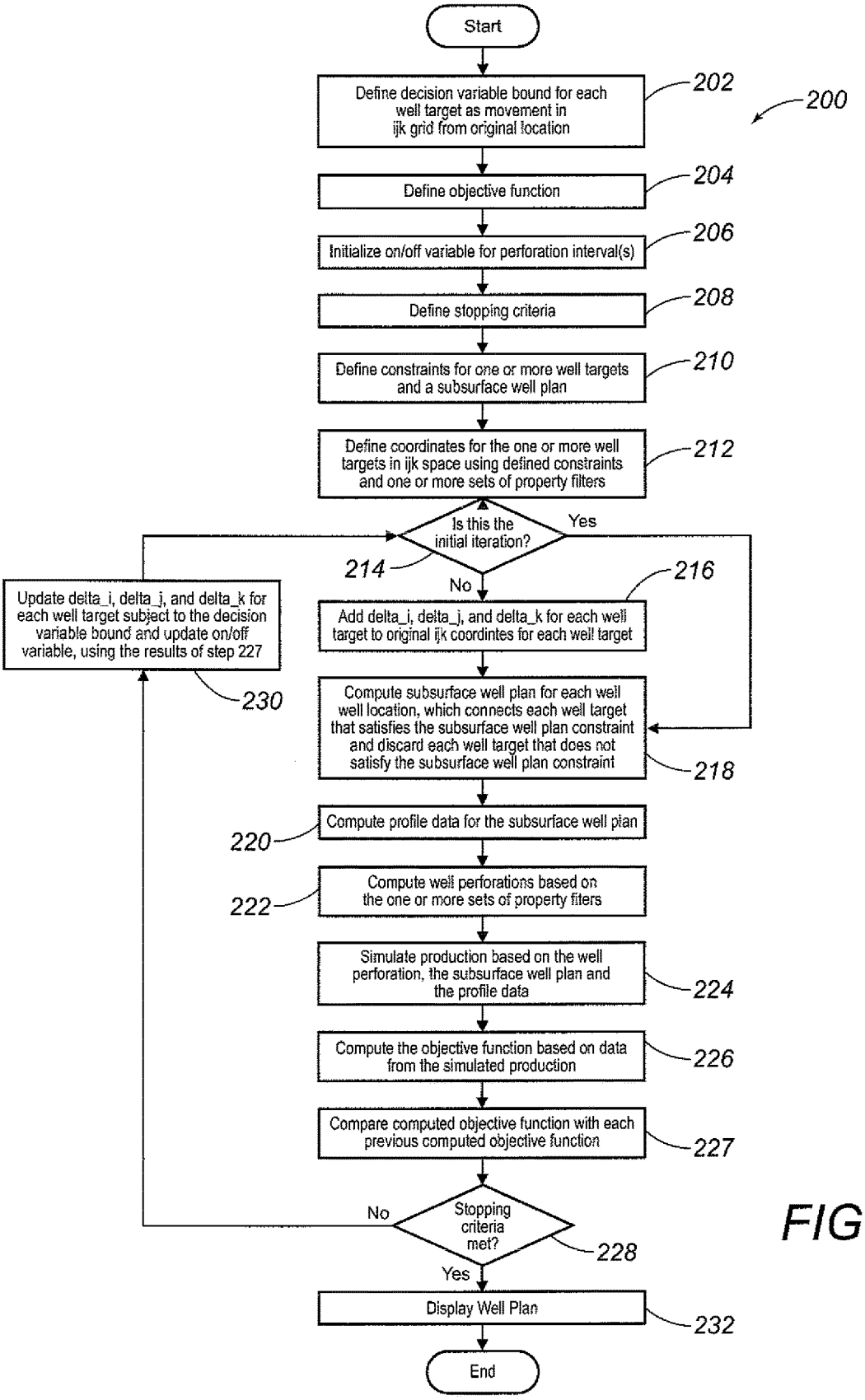
FIG. 2 is a flow diagram illustrating one embodiment of a method for implementing the present invention.

Referring now to FIG. 2, a flow diagram illustrates one embodiment of a method 200 for implementing the present invention. Steps 202-208 are associated with the DMS™ Model and steps 210-232 are associated with the DMS™ Execution. The DMS™ Model and the DMS™ Execution (steps 202-232) may therefore, be processed in a computer-implemented method by the Well Planning Module illustrated in FIG. 1. Steps 202-212 may be implemented as input for the Well Planning Module using the client interface illustrated in FIG. 1.

In step 202, a decision variable bound is defined for each well target as movement in a grid defined by i, j, k coordinates from the well target's original location. In other words, the decision variable bound is defined for each well target based on movement of the well target from its original location. The decision variable bound for each well target represents an acceptable range for movement of the well target within the grid. The same decision variable bound may be used for each well target or each well target may have its own. The well target generally represents a proposed well location that meets predefined constraints and property filters.

In step 204, an objective function is defined for the well location. The objective function, for example, may include an objective representing an optimal position of the well location based on an economic metric or a production metric. Exemplary economic and production metrics may include maximum net present value (NPV), minimum water production, maximum oil recovery, minimum capital cost, minimum risk, and maximum rate of return, for example.

In step 206, an on/off variable for each perforation interval previously computed is initialized. The on/off variable is simply a decision variable representing whether the perforation interval, which may contain a well target, is on or off based upon the results of step 227. The on/off variable is preferably on for the initialization.

In step 208, stopping criteria are defined. Stopping criteria, for example, may include factors or events such as: i) maximum iterations of the method 200; ii) target NPV or oil recovery achieved; iii) global optimality determined; and iv) exhaustion of all combinations of discrete variables. Preferably, the stopping criteria include a maximum number of iterations for the method 200.

In step 210, a constraint for each well target is defined and a constraint for a subsurface well plan is defined. The subsurface well plan constraint may include a well geometry constraint, a well type constraint or a drilling cost constraint. The well geometry constraint represents one of maximum well reach, maximum turn rate or dogleg severity. The well type constraint represents one of horizontal, slanted, multilateral, multi target, single target, producer or injector. The well target constraint may include, for example, a minimum or maximum spacing for each well target and the maximum number of well targets.

Figure 4:
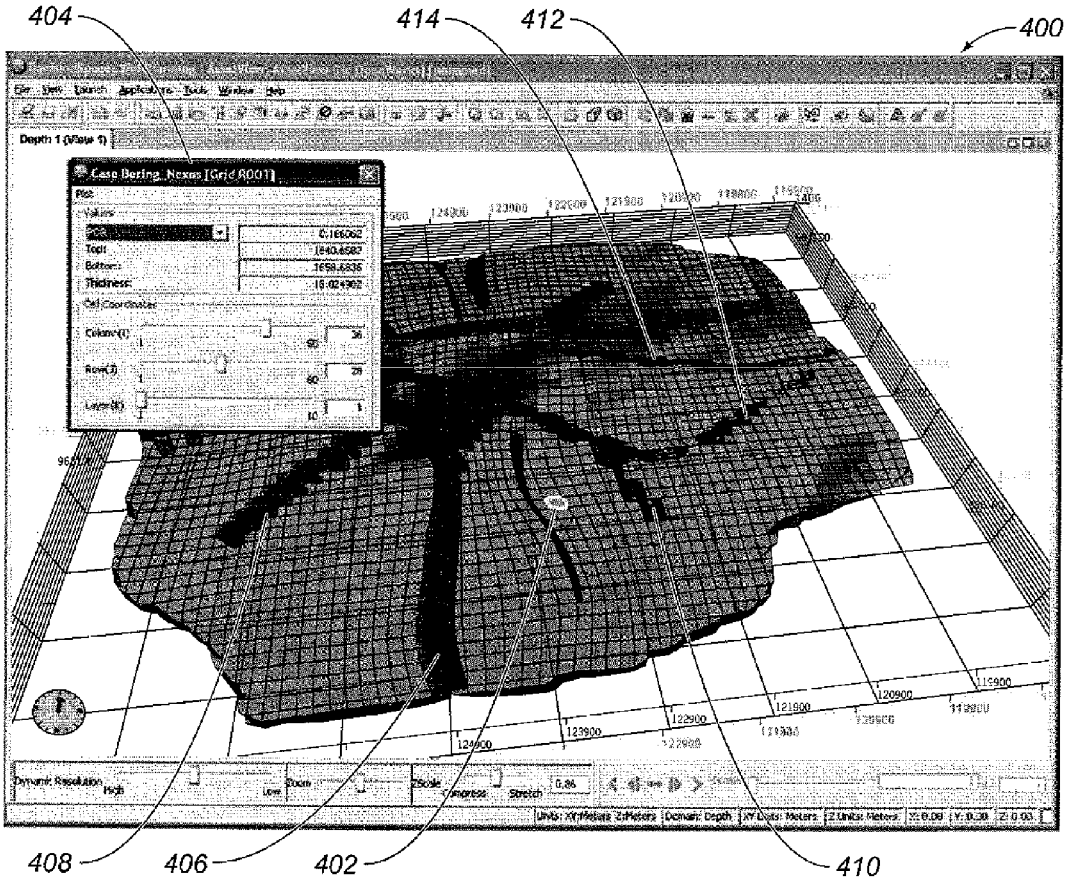
FIG. 4 is an image illustrating step 212 in FIG. 2.
Figure 5:
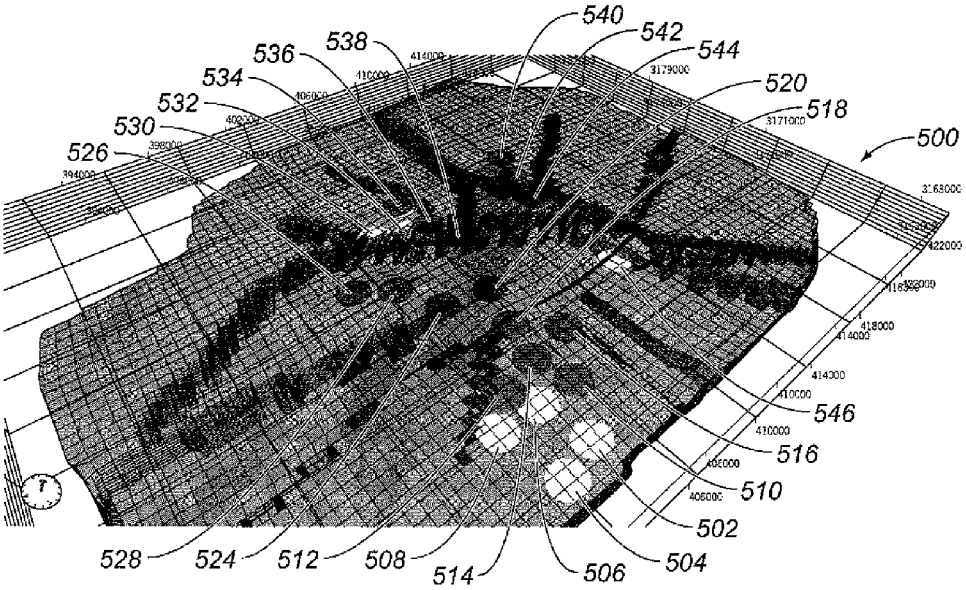
FIG. 5 is an image illustrating step 216 in FIG. 2.

In step 212, i, j, k coordinates for each well target are defined using the constraints defined in step 210 and one or more sets of property filters. In other words, the coordinates for each well target are defined subject to the well target constraint and the one or more sets of property filters. The one or more sets of property filters may include, for example, a pore volume as illustrated by the image in FIG. 4. In FIG. 4, the image includes a display 400 illustrating a three-dimensional grid comprising multiple grid elements. Each grid element includes coordinates. For example, grid element 402 includes coordinates 36(i), 28(j), and 1(k) according to the plot 404. The plot 404 may also be used to display a pore-volume property-filter value for the grid element 402. The property filter therefore, includes property values, which are assigned to each grid element in FIG. 4. Different property values are distinguished in the three-dimensional grid by different shades of gray. Faults 406, 408, 410, 412 and 414, for example, are identified on the three-dimensional grid. Each property filter therefore, limits the possible well target position or location as illustrated by the image in FIG. 5. In FIG. 5, the image includes a display 500 illustrating the same three-dimensional grid, property filter(s) and faults illustrated in FIG. 4. In addition, well targets 502-546 are illustrated in positions and locations limited by the property filter(s) described in reference to FIG. 4.

In step 214, the method 200 determines whether there is an initial iteration. If the method 200 is in an initial iteration, then the method 200 proceeds to step 218. If the method 200 is not in an initial iteration, then the method 200 proceeds to step 216.

In step 216, delta_i, delta_j and delta_k coordinates for each well target are added to the original i, j, k coordinates for each well target using techniques well known in the art. In other words, the updated coordinates for each well target in step 230 are added to the original coordinates for each respective well target. In this manner, each well target may be repositioned based upon its updated coordinates.

Figure 6:
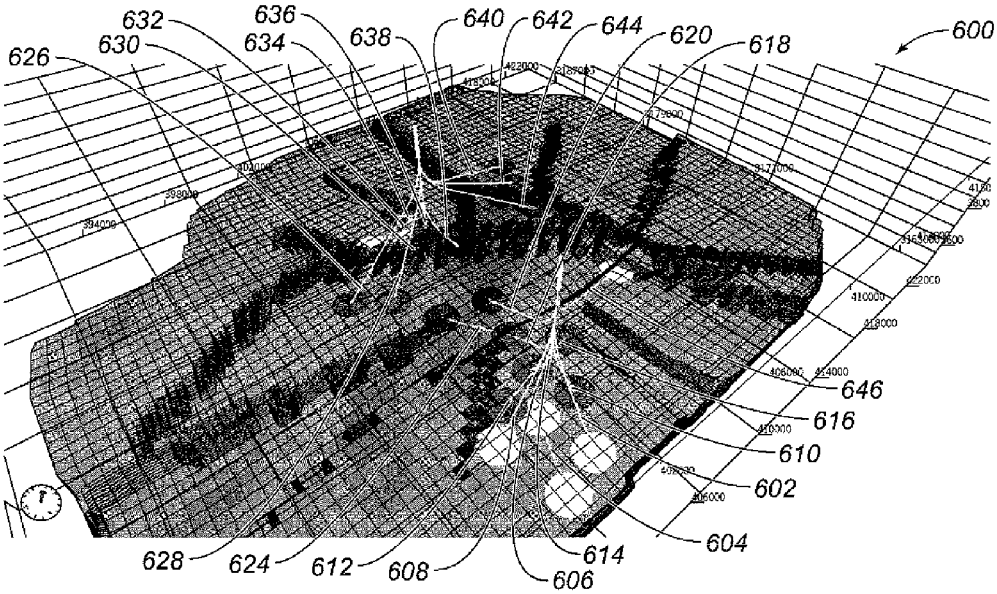
FIG. 6 is an image illustrating step 218 in FIG. 2.

In step 218, a subsurface well plan is computed for each well location using techniques well known in the art, which connects each well target that satisfies the subsurface well plan constraint as illustrated by the image in FIG. 6. Each well target that does not satisfy the subsurface well plan constraint is discarded. In FIG. 6, the image includes a display 600 illustrating two subsurface well plans as exemplary slanted wells. One well plan includes well bores 602, 604, 606, 608, 610, 612, 614, 616, 618, 620, 624 and 646, which correspond with respective well targets. Another well plan includes well bores 626, 628, 630, 632, 634, 636, 638, 640, 642 and 644, which also correspond with respective well targets. The well targets, three-dimensional grid, faults and property filter(s) illustrated in FIG. 6 are the same as the well targets, three-dimensional grid, faults and property filter(s) illustrated in FIG. 5. AssetPlanner™, which is illustrated in FIG. 1, may be used to execute this step in a computer implemented method.

In step 220, profile data for each subsurface well plan are computed using techniques well known in the art. The profile data may include, for example, data representing pipe and tubing connections and trajectories from subsurface locations (e.g. illustrated in FIG. 6) to surface connections. Network Planner™, which is illustrated in FIG. 1, may be used to execute this step in a computer implemented method.

Figure 7:
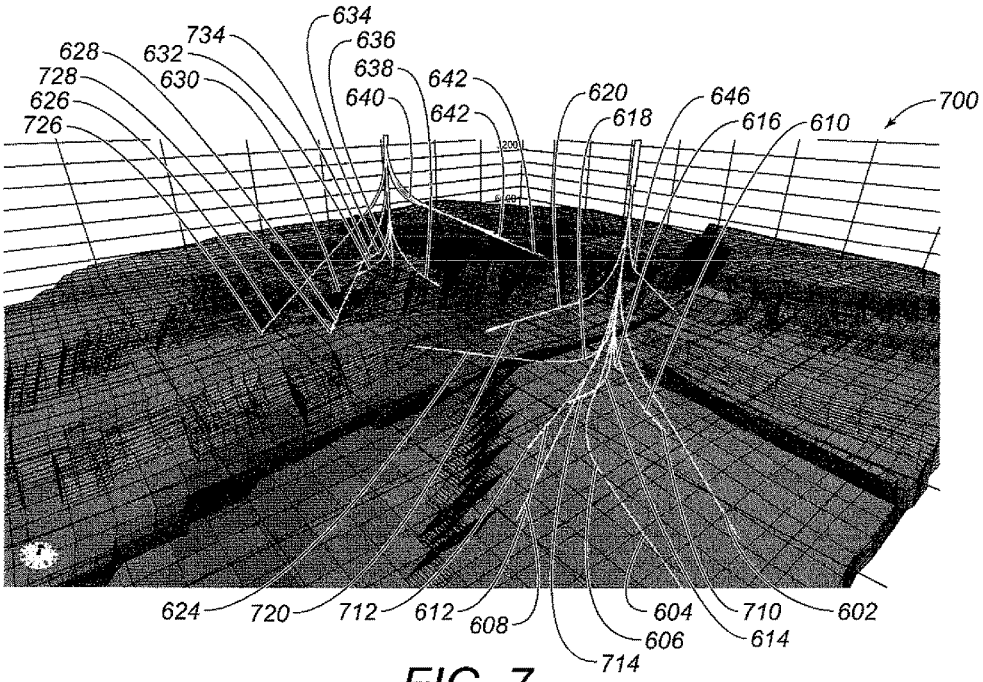
FIG. 7 is an image illustrating step 222 in FIG. 2.

In step 222, each well perforation is computed using techniques well known in the art as illustrated by the image in FIG. 7. A well perforation is computed for each wellbore associated with a well target, based on the one or more sets of property filters. In FIG. 7, the image includes a display 700 illustrating the same well plans, well targets, three-dimensional grid, faults and property filter(s) illustrated in FIG. 6. In addition, one well plan includes well perforations 710, 712 and 714, which are positioned on each corresponding wellbore 610, 612 and 614 based on the one or more sets of property filters. Likewise, the other well plan includes well perforations 720, 726, 728 and 734, which are positioned on each corresponding wellbore 620, 626, 628 and 634 based on the one more sets of property filters. Thus, each property filter limits the possible position or location of each well perforation. DataStudio™, which is illustrated in FIG. 1, may be used to execute this step in a computer implemented method.

In step 224, production is simulated using techniques well known in the art, which is based on the well perforation(s), each subsurface well plan and the corresponding profile data. In this manner, dynamic production criteria are simulated, which represent simulated production data. Nexus®, which is illustrated in FIG. 1, or VIP® may be used to execute this step in a computer implemented method.

In step 226, the objective function is computed using techniques well known in the art, which is based on data from the simulated production. An excel spreadsheet or any other well known economics calculator may be used to execute this step in a computer implemented method.

In step 227, the last computed objective function is compared with each previously computed objective function using techniques well known in the art to determine the best computed objective function. If the method 200 is in an initial iteration, then the best computed objective function is the last computed objective function. Any well known optimizer algorithm may be used to execute this step in a computer implemented method.

In step 228, the method 200 determines whether the stopping criteria are met. If the stopping criteria are met, then the method 200 proceeds to step 232. If the stopping criteria are not met, then the method 200 proceeds to step 230.

In step 230, delta_i, delta_j and delta_k are updated for each well target, subject to the decision variable bound(s), by using techniques well known in the art and the best computed objective function from step 227. In addition, the on/off variable is updated in the same manner using techniques well known in the art and the best computed objective function from step 227. Any well known optimizer may be used to execute this step in a computer implemented method. After completion of step 230, the method 200 returns to step 214 and the method 200 iteratively proceeds through steps 216-228 until the stopping criteria are met.

In step 232, each well plan is displayed in the form generally illustrated in FIG. 7. The well plan displayed in step 232 therefore, may include the subsurface well plan and corresponding profile data.

Figure 3A:
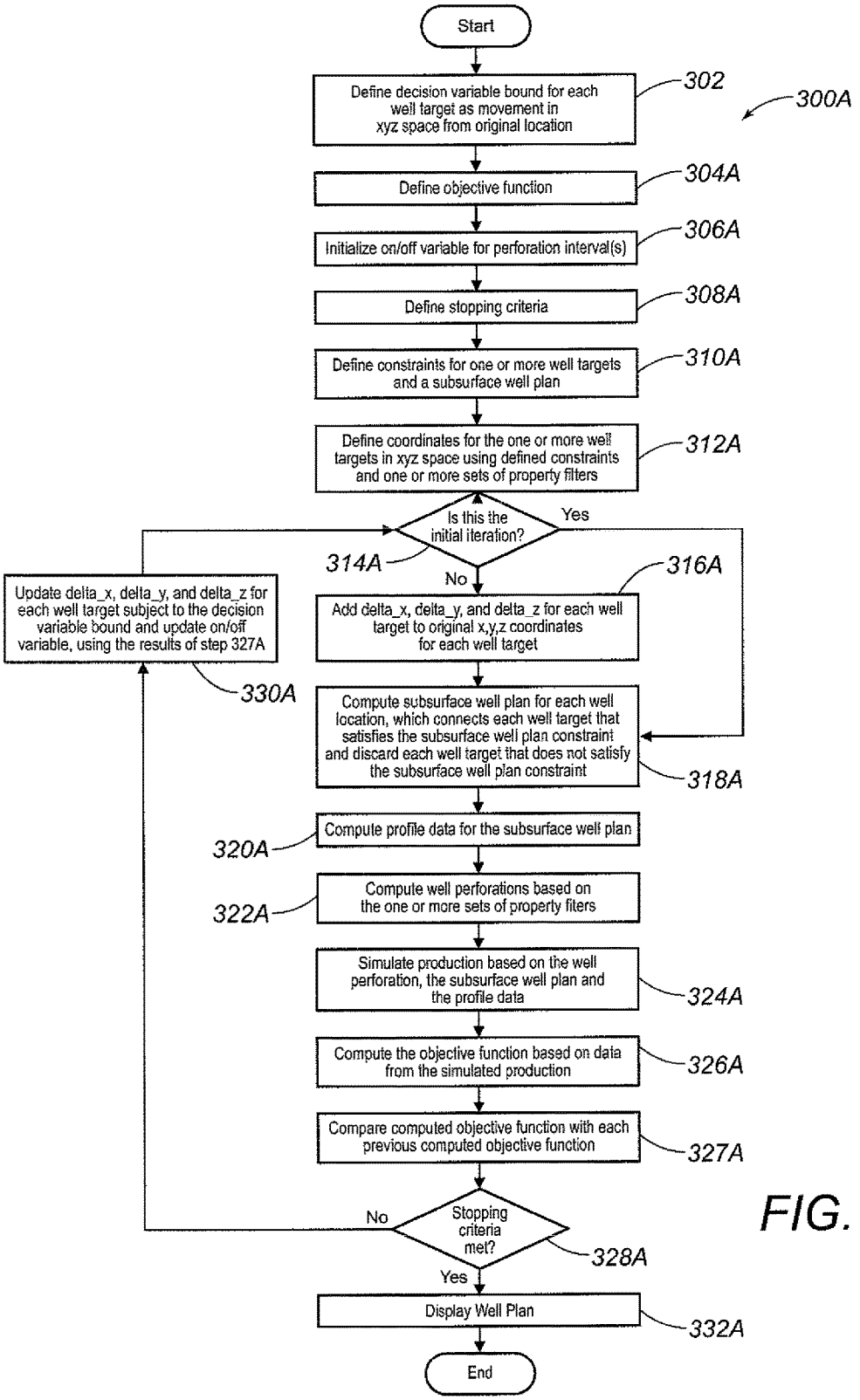
FIG. 3A is a flow diagram illustrating another embodiment of a method for implementing the present invention.

Referring now to FIG. 3A, a flow diagram illustrates another embodiment of a method 300A for implementing the present invention. Steps 302A-308A are associated with the DMS™ Model and steps 310A-332A are associated with the DMS™ Execution. The DMS™ Model and the DMS™ Execution (steps 302A-332A) may therefore, be processed in a computer-implemented method by the Well Planning Module illustrated in FIG. 1. Steps 302A-312A may be implemented as input for the Well Planning Module using the client interface illustrated in FIG. 1.

In step 302A, a decision variable bound is defined for each well target as movement in x, y, z space from the well target's original location. In other words, the decision variable bound is defined for each well target based on movement of the well target from its original location. The decision variable bound for each well target represents an acceptable range for movement of the well target within the grid. The same decision variable bound may be used for each well target or each well target may have its own. The well target generally represents a proposed well location that meets predefined constraints and property filters.

In step 304A, an objective function is defined for the well location. The objective function, for example, may include an objective representing an optimal position of the well location based on an economic metric or a production metric. Exemplary economic and production metrics may include maximum net present value (NPV), minimum water production, maximum oil recovery, minimum capital cost, minimum risk, and maximum rate of return, for example.

In step 306A, an on/off variable for each perforation interval previously computed is initialized. The on/off variable is simply a decision variable representing whether the perforation interval, which may contain a well target, is on or off based upon the results of step 327A. The on/off variable is preferably on for the initialization.

In step 308A, stopping criteria are defined. Stopping criteria, for example, may include factors or events such as: i) maximum iterations of the method 300A; ii) target NPV or oil recovery achieved; iii) global optimality determined; and iv) exhaustion of all combinations of discrete variables. Preferably, the stopping criteria include a maximum number of iterations for the method 300A.

In step 310A, a constraint for each well target is defined and a constraint for a subsurface well plan is defined. The subsurface well plan constraint may include a well geometry constraint, a well type constraint or a drilling cost constraint. The well geometry constraint represents one of maximum well reach, maximum turn rate or dogleg severity. The well type constraint represents one of horizontal, slanted, multilateral, multi target, single target, producer or injector. The well target constraint may include, for example, a minimum or maximum spacing for each well target and the maximum number of well targets.

In step 312A, x, y, z coordinates for each well target are defined using the constraints defined in step 310A and one or more sets of property filters. In other words, the coordinates for each well target are defined subject to the well target constraint and the one or more sets of property filters. The one or more sets of property filters may include, for example, a pore volume.

In step 314A, the method 300A determines whether there is an initial iteration. If the method 300A is in an initial iteration, then the method 300A proceeds to step 318A. If the method 300A is not in an initial iteration, then the method 300A proceeds to step 316A.

In step 316A, delta_x, delta_y and delta_z coordinates for each well target are added to the original x, y, z coordinates for each well target using techniques well known in the art. In other words, the updated coordinates for each well target in step 330A are added to the original coordinates for each respective well target. In this manner, each well target may be repositioned based upon its updated coordinates.

In step 318A, a subsurface well plan is computed for each well location using techniques well known in the art, which connects each well target that satisfies the subsurface well plan constraint. Each well target that does not satisfy the subsurface well plan constraint is discarded. AssetPlanner™, which is illustrated in FIG. 1, may be used to execute this step in a computer implemented method.

In step 320A, profile data for each subsurface well plan are computed using techniques well known in the art. The profile data may include, for example, data representing pipe and tubing connections and trajectories from subsurface locations to surface connections. Network Planner™, which is illustrated in FIG. 1, may be used to execute this step in a computer implemented method.

In step 322A, each well perforation is computed using techniques well known in the art. A well perforation is computed for each wellbore associated with a well target, based on the one or more sets of property filters. Thus, each property filter limits the possible position or location of each well perforation. DataStudio™, which is illustrated in FIG. 1, may be used to execute this step in a computer implemented method.

In step 324A, production is simulated using techniques well known in the art, which is based on the well perforation(s), each subsurface well plan and the corresponding profile data. In this manner, dynamic production criteria are simulated, which represent simulated production data. Nexus®, which is illustrated in FIG. 1, or VIP® may be used to execute this step in a computer implemented method.

In step 326A, the objective function is computed using techniques well known in the art, which is based on data from the simulated production. An excel spreadsheet or any other well known economics calculator may be used to execute this step in a computer implemented method.

In step 327A, the last computed objective function is compared with each previously computed objective function using techniques well known in the art to determine the best computed objective function. If the method 300A is in an initial iteration, then the best computed objective function is the last computed objective function. Any well known optimizer algorithm may be used to execute this step in a computer implemented method.

In step 328A, the method 300A determines whether the stopping criteria are met. If the stopping criteria are met, then the method 300A proceeds to step 332A. If the stopping criteria are not met, then the method 300A proceeds to step 330A.

In step 330A, delta_x, delta_y and delta_z are updated for each well target, subject to the decision variable bound(s), by using techniques well known in the art and the best computed objective function from step 327A. In addition, the on/off variable is updated in the same manner using techniques well known in the art and the best computed objective function from step 327A. Any well known optimizer may be used to execute this step in a computer implemented method. After completion of step 330A, the method 300A returns to step 314A and the method 300A iteratively proceeds through steps 316A-328A until the stopping criteria are met.

In step 332A, each well plan is displayed. The well plan displayed in step 332A therefore, may include the subsurface well plan and corresponding profile data.

Figure 3B:
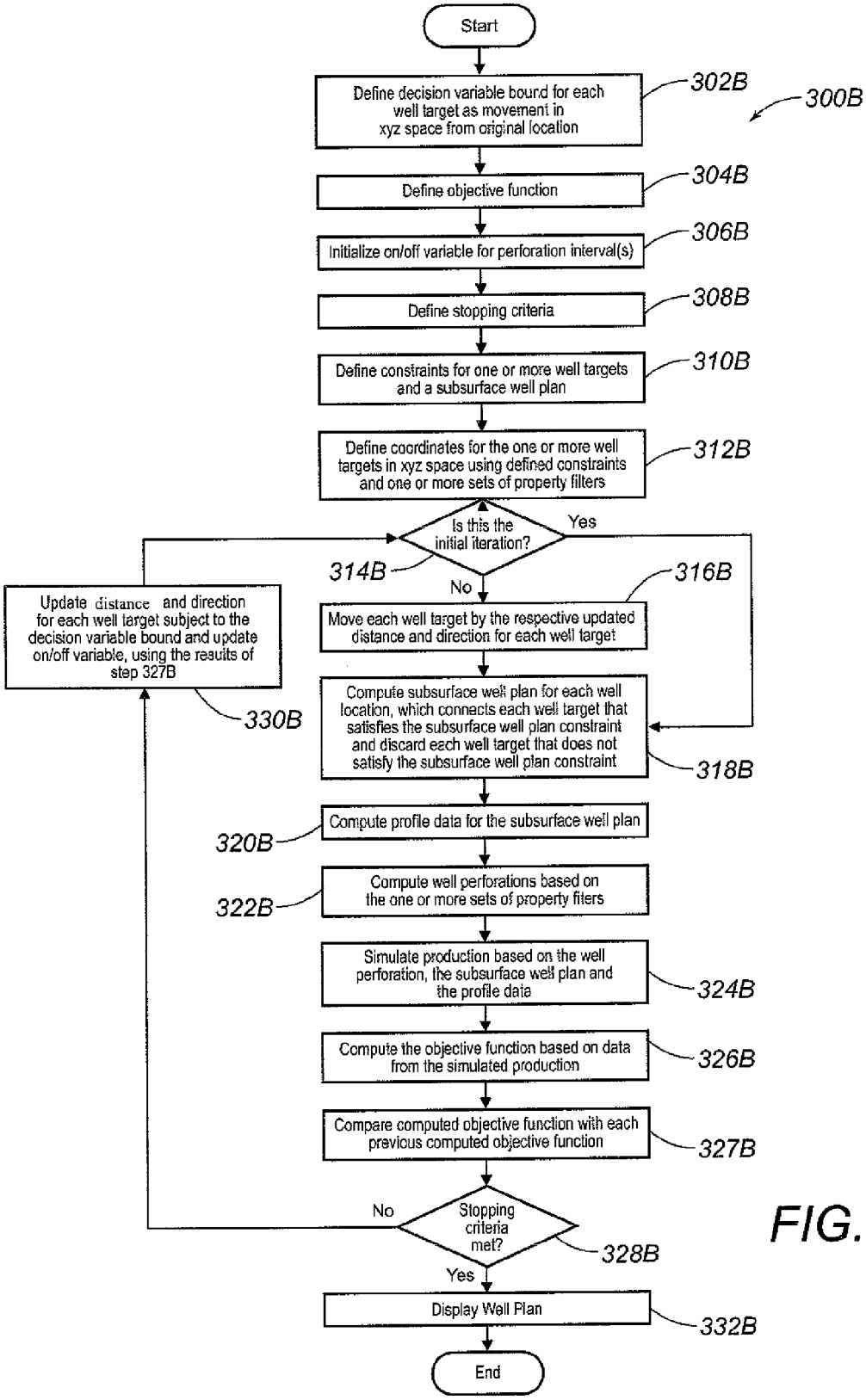
FIG. 3B is a flow diagram illustrating another embodiment of a method for implementing the present invention.

Referring now to FIG. 3B, a flow diagram illustrates another embodiment of a method 300B for implementing the present invention. Steps 302B-308B are associated with the DMS™ Model and steps 310B-332B are associated with the DMS™ Execution. The DMS™ Model and the DMS™ Execution (steps 302B-332B) may therefore, be processed in a computer-implemented method by the Well Planning Module illustrated in FIG. 1. Steps 302B-312B may be implemented as input for the Well Planning Module using the client interface illustrated in FIG. 1.

In step 302B, a decision variable bound is defined for each well target as movement in x, y, z space from the well target's original location. In other words, the decision variable bound is defined for each well target based on movement of the well target from its original location. The decision variable bound for each well target represents an acceptable range for movement of the well target within the grid. The same decision variable bound may be used for each well target or each well target may have its own. The well target generally represents a proposed well location that meets predefined constraints and property filters.

In step 304B, an objective function is defined for the well location. The objective function, for example, may include an objective representing an optimal position of the well location based on an economic metric or a production metric. Exemplary economic and production metrics may include maximum net present value (NPV), minimum water production, maximum oil recovery, minimum capital cost, minimum risk, and maximum rate of return, for example.

In step 306B, an on/off variable for each perforation interval previously computed is initialized. The on/off variable is simply a decision variable representing whether the perforation interval, which may contain a well target, is on or off based upon the results of step 327B. The on/off variable is preferably on for the initialization.

In step 308B, stopping criteria are defined. Stopping criteria, for example, may include factors or events such as: i) maximum iterations of the method 300B; ii) target NPV or oil recovery achieved; iii) global optimality determined; and iv) exhaustion of all combinations of discrete variables. Preferably, the stopping criteria include a maximum number of iterations for the method 300B.

In step 310B, a constraint for each well target is defined and a constraint for a subsurface well plan is defined. The subsurface well plan constraint may include a well geometry constraint, a well type constraint or a drilling cost constraint. The well geometry constraint represents one of maximum well reach, maximum turn rate or dogleg severity. The well type constraint represents one of horizontal, slanted, multilateral multi target, single target, producer or injector. The well target constraint may include, for example, a minimum or maximum spacing for each well target and the maximum number of well targets.

In step 312B, x, y, z coordinates for each well target are defined using the constraints defined in step 310B and one or more sets of property filters. In other words, the coordinates for each well target are defined subject to the well target constraint and the one or more sets of property filters. The one or more sets of property filters may include, for example, a pore volume.

In step 314B, the method 300B determines whether there is an initial iteration. If the method 300B is in an initial iteration, then the method 300B proceeds to step 318B. If the method 300B is not in an initial iteration, then the method 300B proceeds to step 316B.

In step 316B, each well target is moved by a respective updated distance and direction to updated coordinates for each well target using techniques well known in the art. In other words, the updated distance and direction for each well target in step 330B are used to move each well target to new coordinates. In this manner, each well target may be repositioned based upon its updated coordinates. The direction may be measured using angles $\propto$ and $\beta$.

In step 318B, a subsurface well plan is computed for each well location using techniques well known in the art, which connects each well target that satisfies the subsurface well plan constraint. Each well target that does not satisfy the subsurface well plan constraint is discarded. AssetPlanner™, which is illustrated in FIG. 1, may be used to execute this step in a computer implemented method.

In step 320B, profile data for each subsurface well plan are computed using techniques well known in the art. The profile data may include, for example, data representing pipe and tubing connections and trajectories from subsurface locations to surface connections. Network Planner™, which is illustrated in FIG. 1, may be used to execute this step in a computer implemented method.

In step 322B, each well perforation is computed using techniques well known in the art. A well perforation is computed for each wellbore associated with a well target, based on the one or more sets of property filters. Thus, each property filter limits the possible position or location of each well perforation. DataStudio™, which is illustrated in FIG. 1, may be used to execute this step in a computer implemented method.

In step 324B, production is simulated using techniques well known in the art, which is based on the well perforation(s), each subsurface well plan and the corresponding profile data. In this manner, dynamic production criteria are simulated, which represent simulated production data. Nexus®, which is illustrated in FIG. 1, or VIP® may be used to execute this step in a computer implemented method.

In step 326B, the objective function is computed using techniques well known in the art, which is based on data from the simulated production. An excel spreadsheet or any other well known economics calculator may be used to execute this step in a computer implemented method.

In step 327B, the last computed objective function is compared with each previously computed objective function using techniques well known in the art to determine the best computed objective function. If the method 300B is in an initial iteration, then the best computed objective function is the last computed objective function. Any well known optimizer algorithm may be used to execute this step in a computer implemented method.

In step 328B, the method 300B determines whether the stopping criteria are met. If the stopping criteria are met, then the method 300B proceeds to step 332B. If the stopping criteria are not met, then the method 300B proceeds to step 330B.

In step 330B, the coordinates for each well target are updated using a respective distance and direction for each well target, subject to the decision variable bound(s). The coordinates for each well target are updated using techniques well known in the art and the best computed objective function from step 327B. In addition, the on/off variable is updated in the same manner using techniques well known in the art and the best computed objective function from step 327B. Any well known optimizer may be used to execute this step in a computer implemented method. After completion of step 330B, the method 300B returns to step 314B and the method 300B iteratively proceeds through steps 316B-328B until the stopping criteria are met.

In step 332B, each well plan is displayed. The well plan displayed in step 332B therefore, may include the subsurface well plan and corresponding profile data.

The present invention therefore: i) optimizes planning and positioning of well locations while simultaneously verifying well drillability and hazards; ii) computes updates to true well geometry/trajectory and tie-back connections to pipelines and delivery systems; and iii) locates optimal formation perforation zones with true production from the dynamic flow of oil, gas and water. The present invention overcomes the deficiencies of the conventional methods described herein by recomputing the wellbore geometry and honoring drilling constraints while planning each well location. The well plan therefore, is based on dynamic production criteria.

While the present invention has been described in connection with presently preferred embodiments, it will be understood by those skilled in the art that it is not intended to limit the invention to those embodiments. It is therefore, contemplated that various alternative embodiments and modifications may be made to the disclosed embodiments without departing from the spirit and scope of the invention defined by the appended claims and equivalents thereof.

The invention claimed is:

1. A method for planning a well location, the method comprising:

defining, by a processing unit, coordinates for each well target in a plurality of well targets subject to a well target constraint and one or more sets of property filters, wherein the one or more sets of property filters includes a pore volume property filter value assigned to each grid element in a three-dimensional grid representing a geological model;

generating, by the processing unit, a subsurface well plan for the well location by:

connecting together well targets in the plurality of well targets that satisfy a subsurface well plan constraint, the subsurface well plan constraint comprising a well type constraint or a drilling cost constraint; and discarding from the plurality of well targets at least one well target that does not satisfy the subsurface well plan constraint;

generating, by the processing unit, profile data for the subsurface well plan;

computing, by the processing unit, a well perforation based on the one or more sets of property filters;

generating, by the processing unit, simulation data by simulating production based on (i) the well perforation, (ii) the subsurface well plan, and (iii) the profile data;

computing, by the processing unit, an objective function for the well location based on simulation data to generate a computed objective function, wherein the objective function is usable to identify an optimal position of the well location based on an economic metric or a production metric;

determining, by the processing unit, whether one or more stopping criteria are met; and drilling a well at the well location.

2. The method of claim 1, further comprising:

for each respective well target in the plurality of well targets:

generating updated coordinates for the respective well target subject to a decision variable bound by using the computed objective function;

updating an on/off variable for a perforation interval containing the respective well target using the computed objective function; and adding the updated coordinates for the respective well target to the coordinates for the respective well target or moving the respective well target to the updated coordinates;

computing a new subsurface well plan for the well location by:

connecting together well targets in the plurality of well targets that satisfy the subsurface well plan constraint; and discarding from the plurality of well targets each well target that does not satisfy the subsurface well plan constraint;

computing new profile data for the new subsurface well plan;

computing a new well perforation based on the one or more sets of property filters;

generating new simulation data by simulating new production based on (i) the new well perforation, (ii) the new subsurface well plan, and (iii) the new profile data;

computing a new objective function based on the new simulation data; and determining whether the one or more stopping criteria are met.

3. The method of claim 2, wherein:

the coordinates for each well target are updated subject to the decision variable bound by using a best computed objective function according to a predetermined criterion; and the on/off variable is updated using the best computed objective function.

4. The method of claim 2, wherein the decision variable bound for the respective well target represents a predefined range for movement of the respective well target from an original location of the respective well target.

5. The method of claim 2, wherein the coordinates for the respective well target are updated using grid coordinates, Cartesian coordinate, or a distance and direction.

6. The method of claim 5, wherein the coordinates for the respective well target are updated using the distance and direction, and wherein the direction is measured using angles.

7. The method of claim 1, wherein the objective function includes an objective representing an optimal position of the well location based on an economic metric or a production metric.

8. The method of claim 1, wherein the well target constraint includes a minimum spacing or a maximum spacing for each well target.

9. The method of claim 1, wherein the subsurface well plan constraint is the well type constraint, and wherein the well type constraint represents one of a horizontal well, a slanted well, a multilateral well, a multi-target well, a single-target well, a producer well, or an injector well.

10. The method of claim 1, wherein the profile data represents pipe and tubing connections and trajectories from subsurface locations to surface connections.

11. The method of claim 1, further comprising:

displaying a well plan for the well location, the well plan including the subsurface well plan and the profile data.

12. The method of claim 1, wherein the subsurface well plan constraint is the drilling cost constraint.

13. The method of claim 1, wherein the simulation data is generated dynamically by a reservoir simulator.

14. The method of claim 1, wherein the well location is an optimal location as defined according to a predetermined criteria.

* * * * *